US010359218B2

(12) United States Patent
Byers et al.

(10) Patent No.: US 10,359,218 B2
(45) Date of Patent: Jul. 23, 2019

(54) MANIFOLD DESIGN TO ELIMINATE FRACTURES ON MULTISTAGE HEAT EXCHANGER COILS

(71) Applicant: Lennox Industries Inc., Richardson, TX (US)

(72) Inventors: Tate Byers, Dallas, TX (US); Aylan Him, Coppell, TX (US); Gregory Ruhlander, Little Elm, TX (US); Claudia A. Morales, Rockwall, TX (US); David Mackey, Addison, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/337,810

(22) Filed: Oct. 28, 2016

(65) Prior Publication Data

US 2018/0120001 A1 May 3, 2018

(51) Int. Cl.

| | |
|---|---|
| ***F25B 39/00*** | (2006.01) |
| ***F28D 1/04*** | (2006.01) |
| ***F28F 9/02*** | (2006.01) |
| ***F28D 1/053*** | (2006.01) |
| ***F28F 1/12*** | (2006.01) |
| *F25B 39/04* | (2006.01) |
| *F28D 21/00* | (2006.01) |

(52) U.S. Cl.

CPC ..... *F25B 39/00* (2013.01); *F28D 1/0417* (2013.01); *F28D 1/0443* (2013.01); *F28D 1/05391* (2013.01); *F28F 1/124* (2013.01); *F28F 9/0202* (2013.01); *F25B 39/04* (2013.01); *F28D 2021/0063* (2013.01); *F28F 2260/02* (2013.01); *F28F 2265/26* (2013.01); *F28F 2270/02* (2013.01)

(58) Field of Classification Search

CPC ..... F25B 39/00; F25B 39/04; F28F 9/0202; F28D 1/05308; F28D 1/05358; F28D 1/0443

See application file for complete search history.

(56) References Cited

U.S. PATENT DOCUMENTS

| | | | | |
|---|---|---|---|---|
| 7,360,584 | B2 * | 4/2008 | Hunzinger | F28D 1/0443 165/140 |
| 2002/0040776 | A1 * | 4/2002 | Kokubunji | F28D 1/0443 165/140 |
| 2005/0006069 | A1 * | 1/2005 | Kamiyama | F28D 1/0443 165/140 |
| 2012/0011867 | A1 * | 1/2012 | Koons | F25B 39/04 62/115 |

* cited by examiner

*Primary Examiner* — Jon T. Schermerhorn, Jr.
(74) *Attorney, Agent, or Firm* — Baker Botts L.L.P.

(57) ABSTRACT

A system and method for a multistage condenser is described that reduces problems associated with temperature and pressure differential strains on tubes above and below a dead tube. Instead of connecting the dead tube to the I/O manifold, a physical separation is created. The physical separation can be created by shortening the dead tube, coring a portion of the I/O manifold where the dead tube is received, independent I/O manifolds, or other means.

16 Claims, 9 Drawing Sheets

MANIFOLD DESIGN TO ELIMINATE FRACTURES ON MULTISTAGE HEAT EXCHANGER COILS

TECHNICAL FIELD

The present disclosure is directed to HVAC systems and more particularly to multistage condensers.

BACKGROUND OF THE INVENTION

HVAC systems generally comprise an evaporator leading to a compressor, that leads to a condenser, that leads to an expansion device, that leads back to the evaporator. Refrigerant traveling through the HVAC components goes from a liquid to a gas in the evaporator, and from a gas to a liquid in the condenser. One typical condenser type is a microchannel condenser. Refrigerant can pass through a series of channels in a microchannel condenser and condense from a gas to a liquid as air passes over the channels. Some condensers are multistage, meaning that one set of channels is for a determined load on the HVAC system. For higher loads, a second or third set of channels may also be used.

BRIEF SUMMARY OF THE INVENTION

One embodiment of the present disclosure comprises a multistage condenser for use in an HVAC system, comprising: a first inlet/outlet manifold comprising; a first inlet configured to receive refrigerant from a first compressor; a first outlet configured to carry refrigerant away from the first inlet/outlet manifold; a first plurality of tubes; a second inlet/outlet manifold comprising; a second inlet configured to receive refrigerant from a second compressor; a second outlet configured to carry refrigerant away from the second inlet/outlet manifold; a second plurality of tubes; a return manifold connected to the first and second plurality of tubes and fluidly coupled to the first and second inlet/outlet manifolds; a dead tube, the dead tube connected to the return manifold and extending at least partially into a space between the first and second inlet/outlet manifolds.

Another embodiment of the present disclosure comprises a multistage condenser, comprising: a first stage comprising a first inlet, a first outlet, a first inlet/outlet manifold, a first plurality of tubes, and a return manifold, the first stage configured to circulate a refrigerant; a second stage comprising a second inlet, a second outlet, a second inlet/outlet manifold, a second plurality of tubes, and the return manifold, the second stage configured to circulate a refrigerant, wherein the second inlet/outlet manifold is separated from the first inlet/outlet manifold by a space; and a dead tube coupled to the return manifold and positioned between the first and second stages.

Another embodiment of the present disclosure comprises a method of manufacturing a multistage condenser, comprising: providing a first stage, the first stage comprising a first inlet, a first outlet, a first inlet/outlet manifold, a first plurality of tubes, and a return manifold, the first stage configured to circulate a refrigerant; providing a second stage, the second stage comprising a second inlet, a second outlet, a second inlet/outlet manifold, a second plurality of tubes, and the return manifold, the second stage configured to circulate a refrigerant, wherein the second inlet/outlet manifold is separated from the first inlet/outlet manifold by a space; and providing a dead tube, the dead tube coupled to the return manifold and positioned between the first and second stages and extending into the space.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
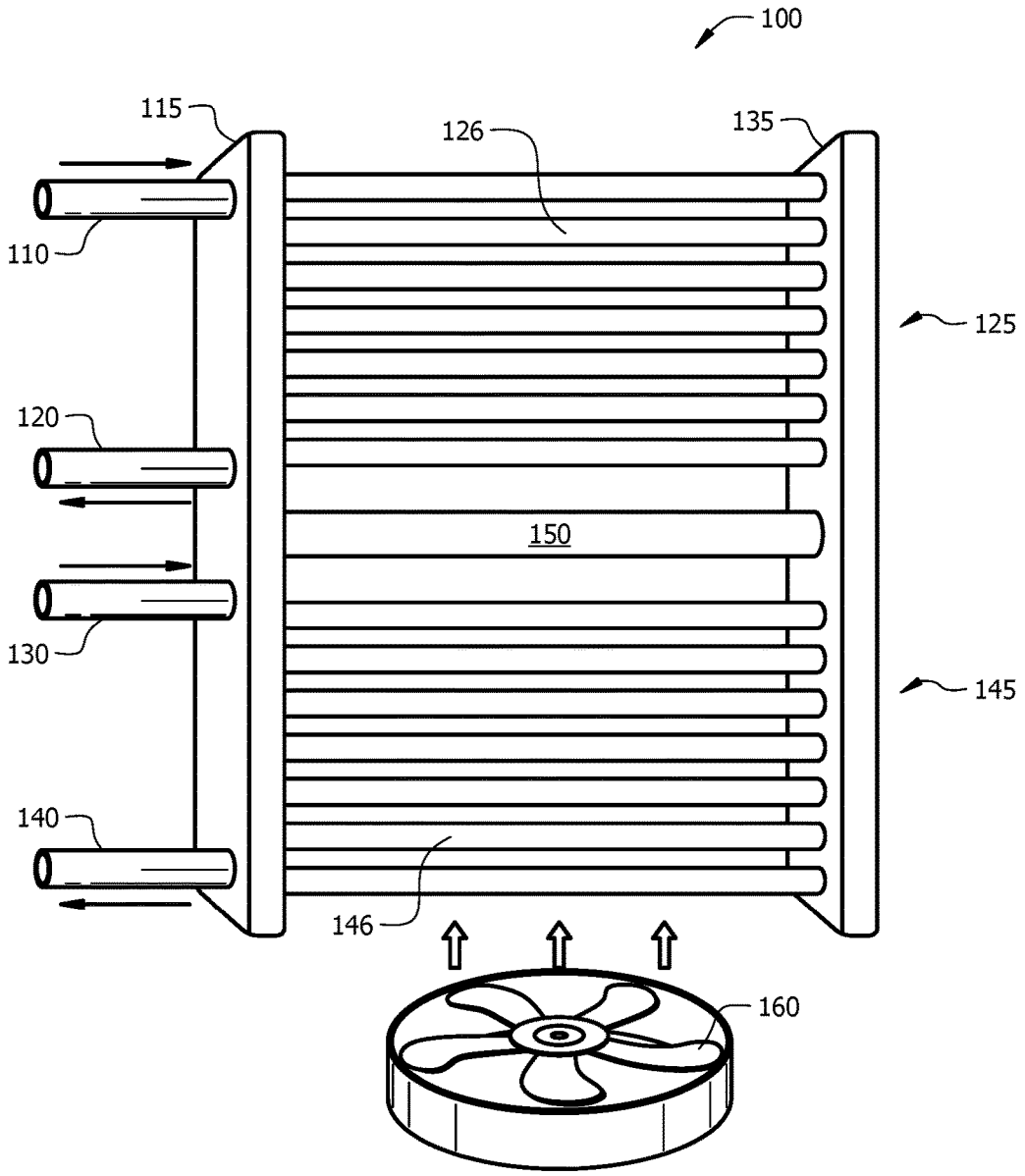
FIG. 1 is a diagram of an embodiment of a multistage condenser.

One problem in multistage microchannel condensers or heat exchangers is the creation of stresses and strains around the dead tube. The dead tube separates stages of the condenser from each other. There may be a single dead tube between each stage. Referring now to FIG. 1, a prior art multistage condenser 100 can be seen. Condenser 100 comprises two stages 125, 145. Inlet 110 provides refrigerant to the first stage 125. Inlet 130 provides refrigerant to the second stage 145. After traveling through channels 126 and 146 the refrigerant leaves the stages by outlets 120, 140. Fan 160 provides airflow across the condenser 100. Inlet/outlet ("I/O") manifold 115 and return manifold 135 join the channels of each stage. Dead tube 150 separates stage 125 from stage 145. Dead tube 150 has been isolated from the other channels 126, 146 by sealing the interior of the manifolds 115, 135 with baffles around the dead tube 150 so that refrigerant does not enter. The refrigerant flowing out of I/O manifold 115 via outlet 120 is cooler than the refrigerant entering I/O manifold 115 at inlet 130. Refrigerant at outlet 120 also has a lower pressure than at inlet 130. This temperature and pressure difference causes expansions and contraction at different times and rates, creating strain in the refrigerant tubes above and below the dead tube 150, or generally in and around dead tube 150. Over time these strains can cause failure.

Figure 2:
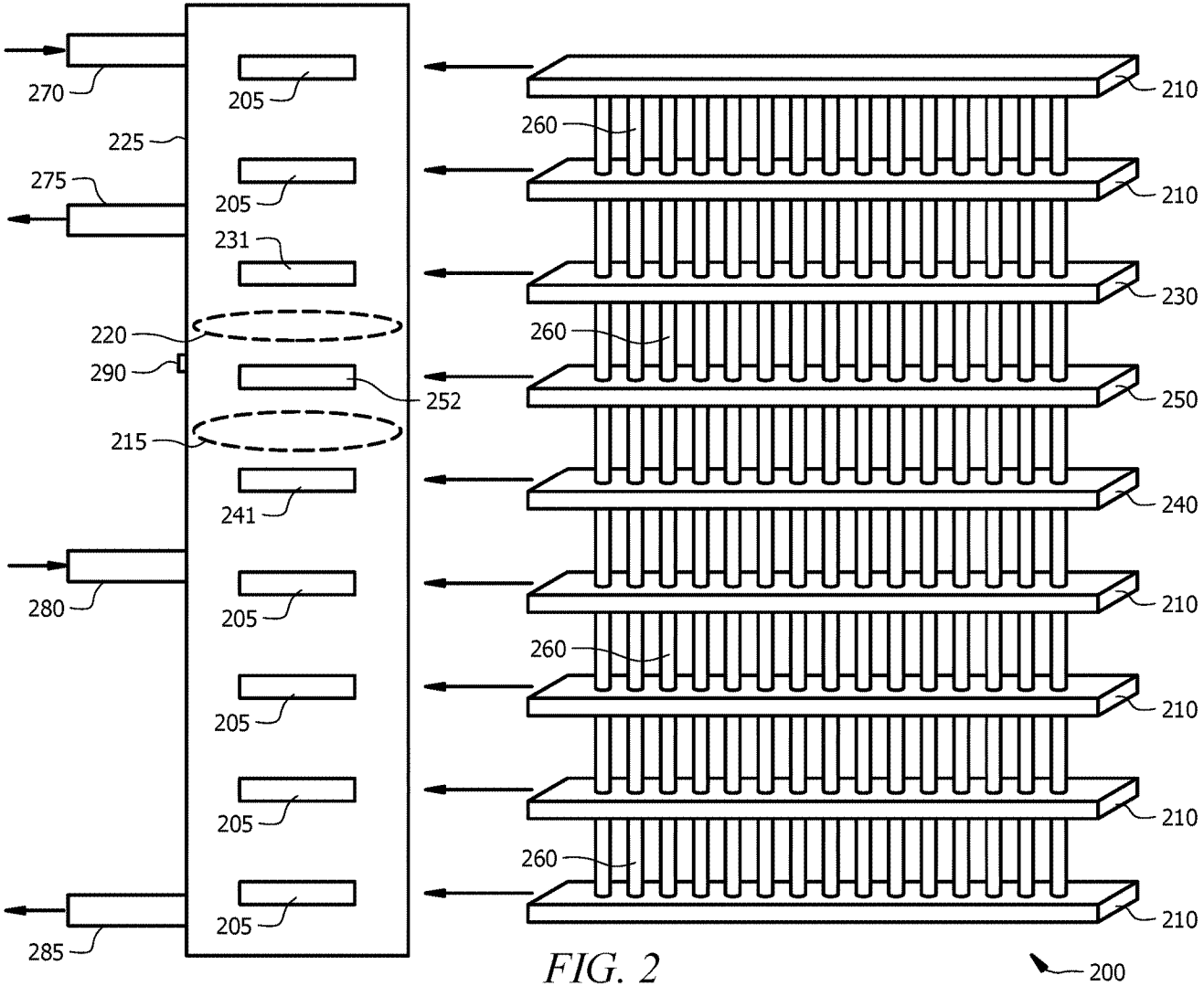
FIG. 2 is a diagram of an embodiment of a multistage condenser.

FIG. 2 displays how portions of a multistage condenser can fit together. I/O manifold 225 comprises a plurality of slots 205 which can receive tubes 210. Each tube 210 can comprise a plurality of microchannels. Tubes 210 can insert into a return manifold (not shown) on the other end. Fins 260 extend between each tube to aid in heat transfer. Dead tube 250 slides into the dead tube slot 252. Baffles 215, 220 sit above and below the dead tube slot 252 to prevent refrigerant from reaching the dead tube 250. Vent 290 allows venting of the dead tube 250 and area between the baffles 215, 220. First tube above dead tube 230 slides into the slot 231. First tube below the dead tube 240 slides into the slot 241. Fins 260 are attached to tubes 210, 250, 230, 240 often by a braising type process or by putting the condenser through a heating treatment that forms bonds between fins 260 and tubes 210, 250. Generally, the pieces of the system are assembled together, and tubes inserted into slots, and fins arranged between the tubes, then the whole system goes through a heating treatment. The heating treatment helps join everything together, usually by melting, or partially melting, a brazing material. Once tubes 210, 250 are placed in slots 205, 252 there can be a braising process, or other sealing process, to join the tubes 210, 250 and I/O manifold 225. Inlet 270 provides refrigerant to the I/O manifold 225 for the first condenser stage. Refrigerant leaves the first stage via outlet 275. Refrigerant enters and leaves the second stage via inlet 280 and outlet 285. As lower temperature and pressure refrigerant leaves outlet 275, and higher temperature and pressure refrigerant enters inlet 280, the areas around the dead tube 250, tube above dead tube 230, tube below the dead tube 240, slots 252, 231, 241, and baffles 215, 220, tend to experience increased strains caused by differences in temperature and pressures. Eventually failure can occur.

One solution to the problem of failure in and around dead tubes, and the tubes above and below the dead tube, is to physically separate the dead tube from one or both manifolds. This can be accomplished under the present disclosure in several different ways. The dead tube can be cut short so as not to engage either manifold. Portions of the manifold can also be cut out so that the manifold does not engage the dead tube. Another embodiment can comprise the division of the manifold into two separate pieces, so that neither piece touches the dead tube.

Figure 3:
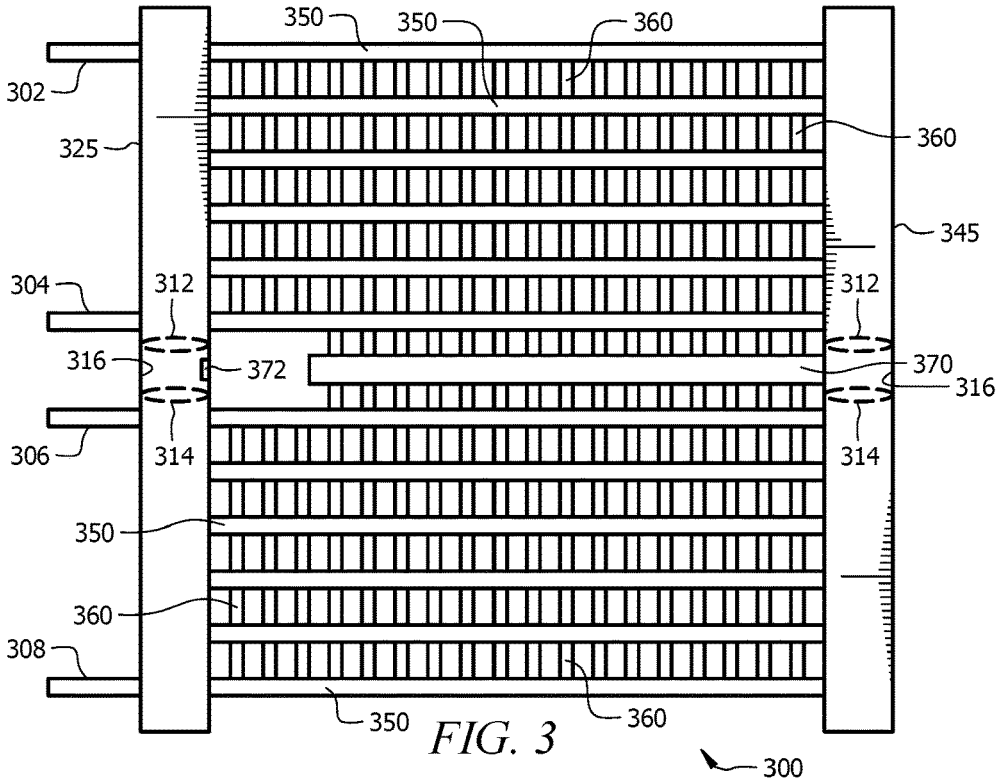
FIG. 3 is a diagram of an embodiment of a multistage condenser under the present disclosure.

FIG. 3 displays one possible embodiment under the present disclosure. Multistage condenser 300 comprises I/O manifold 325 and return manifold 345. Tubes 350 extend between and connect to the manifolds 325, 345. Fins 360 extend between the tubes 350 to increase the heat transfer. Inlet 302 and outlet 304 carry refrigerant to and from the first stage of the condenser 300. Inlet 306 and outlet 308 carry refrigerant to and from the second stage. Dead tube 370 is cut short so as not to engage I/O manifold 325 or dead tube slot 372. Baffles 312, 314 on each manifold 325, 345 keep refrigerant from leaking, and vents 316 allows pressurized or heated gases or air to escape. As lower temperature and pressure refrigerant leaves outlet 304 and higher temperature and pressure refrigerant enters inlet 306, the area around the tubes above and below dead tube slot 372 undergoes stresses as material expands and contracts. These stresses can result during periods that the second stage is activated, and also during deactivated periods. However, in the embodiment shown, the dead tube is not connected to the manifold. It has been found that separating the dead tube 370 from I/O manifold 325 reduces compressive strains found on the tubes directly above and below the dead tube 370. Remaining strains tend to be more axial in nature. Furthermore, there are fewer distinct materials present that undergo varying expansion and contraction depending on their heat transfer properties. There is no brazing around slot 372, and no connected dead tube 370, or any different materials other than the manifold, to experience these strains and stresses.

The embodiment of FIG. 3 will generally be made by shortening the dead tube 370 ahead of assembly with the manifolds. The embodiment of FIG. 3 shows the fins 360 around the dead tube 370 as stopped short of the manifold. In other embodiments the fins 360 can overhang the dead tube 370 and extend closer to the manifold. FIG. 3 shows an I/O manifold 325 that comprises a dead tube slot 372. In the manufacture of manifolds it will likely be cheaper to include a dead tube slot 372, as it is created along with all the other slots for tubes. But the present disclosure can be applied to embodiments lacking a dead tube slot 372.

Figure 4:
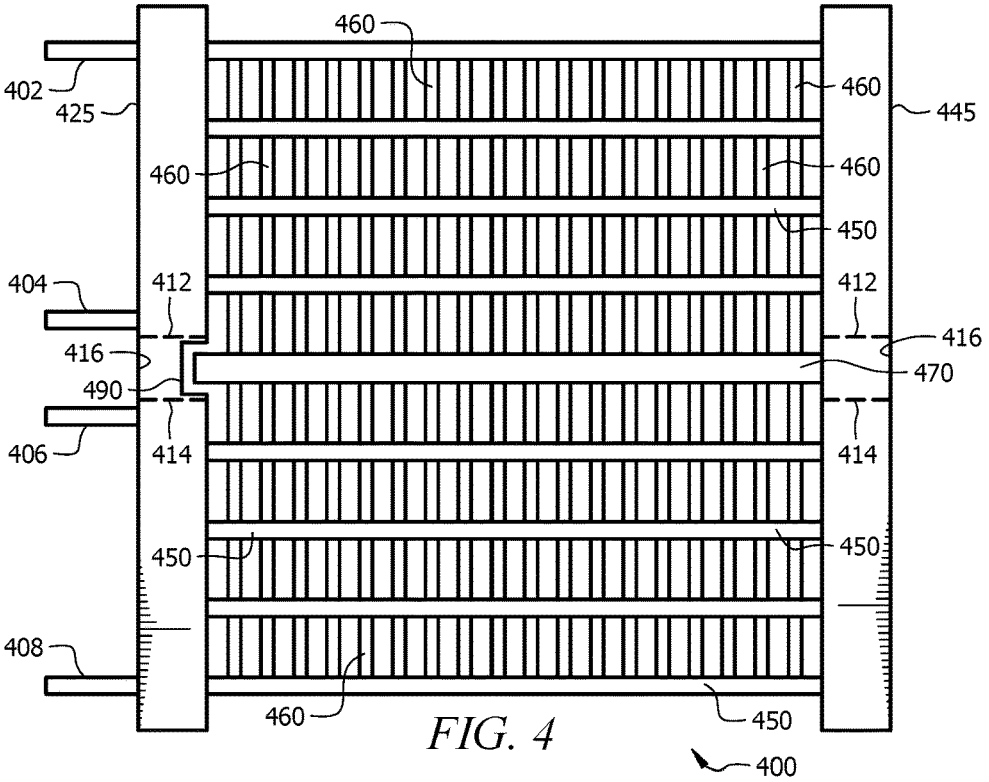
FIG. 4 is a diagram of an embodiment of a multistage condenser under the present disclosure.

FIG. 4 displays another embodiment under the present disclosure. Condenser 400 comprises I/O manifold 425, return manifold 445 and tubes 450 connected there between. Fins 460 connect the tubes 450. Inlet 402 and outlet 404 serve the first stage of the condenser 400. Inlet 406 and outlet 408 serve the second stage of the condenser 400. Dead tube 470 extends from return manifold 445 toward I/O manifold 425. Manifold 425 comprises a cored portion 490 that allows the dead tube 470 to be full length but still not engage the manifold 425. The cored portion 490, may extend approximately ⅜ of the way around the perimeter of the manifold, in a preferred embodiment. In other embodiments the cored portion 490 may extend a smaller or larger distance around the circumference, but the cored portion 490 is preferably less than half of the diameter or width of the manifold. Baffles 412, 414 prevent leaks from the first and second stages. Vents 416 can provide venting of gases. Similar to the embodiment of FIG. 3, condenser 400 prevents physical contact between dead tube 470 and I/O manifold 425. Strains from expansion and contraction are reduced because of the lack of physical contact between the dead tube 470 and manifold I/O 425. Cored portion 490 can take a variety of shapes: circular, rounded, squared, triangular, small, big, or any appropriate size or shape.

Figure 5:
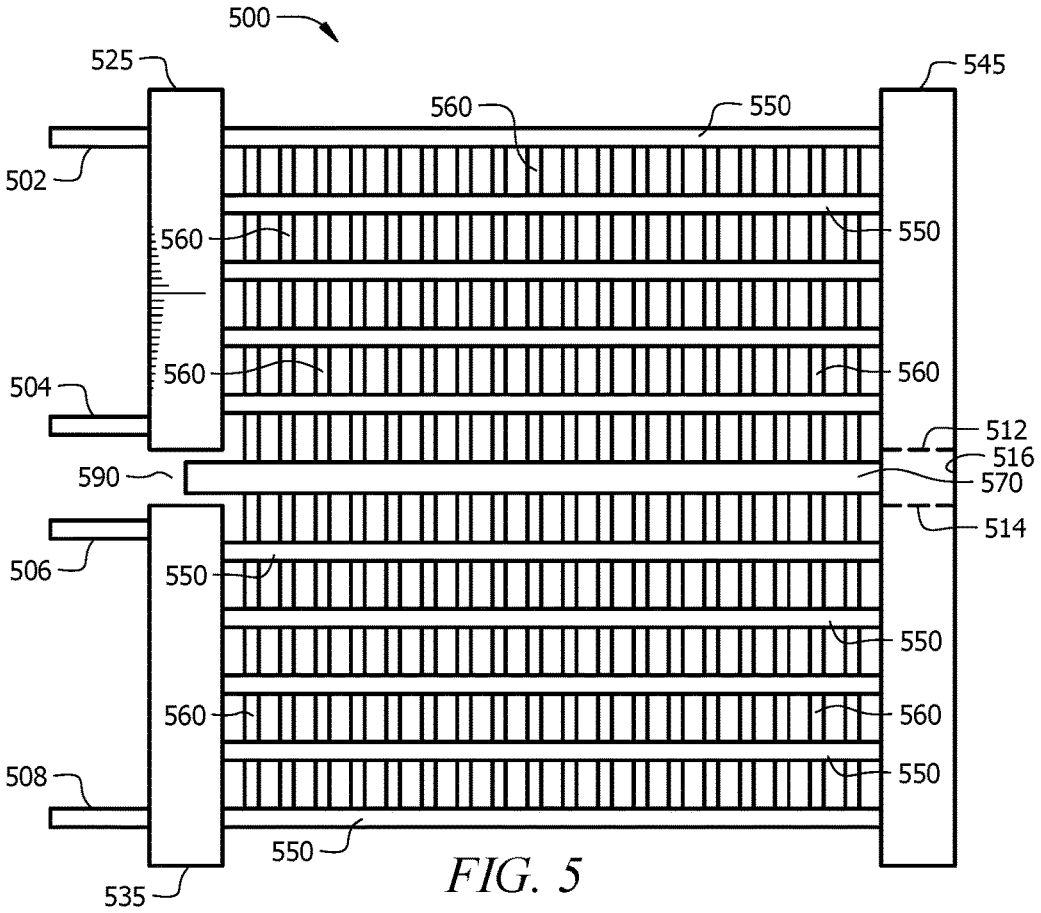
FIG. 5 is a diagram of an embodiment of a multistage condenser under the present disclosure.

FIG. 5 displays another embodiment under the present disclosure. Condenser 500 comprises two I/O manifolds 525, 535 and one return manifold 545. Baffles 512, 514 prevent leaks from the first and second stages. Vent 516 can provide venting of gases. Dead tube 570 connects to return manifold 545, but extends toward an open space 590 between I/O manifolds 525 and 535. The first I/O manifold 525 connects to tubes 550 of the first stage of condenser 500. The second I/O manifold 535 connects to tubes 550 of the second stage of condenser 500. By using separate I/O manifolds 525, 535 on one side of the condenser the strains caused by temperature differentials near a dead tube can be reduced and a physical separation is maintained between the dead tube 570 and I/O manifolds 525, 535. The embodiment of FIG. 5 can be manufactured by creating two individual I/O manifolds and connecting them to a single return manifold by a plurality of tubes prior to the brazing or any other joining process. Alternatively, the embodiment can be created by taking a pre-existing multistage condenser and dividing the I/O manifold into two. FIG. 5 shows the dead tube 570 extending into space 590 between I/O manifolds 525, 535. In other embodiments, the dead tube 570 can stop short of the space 590.

Figure 6:
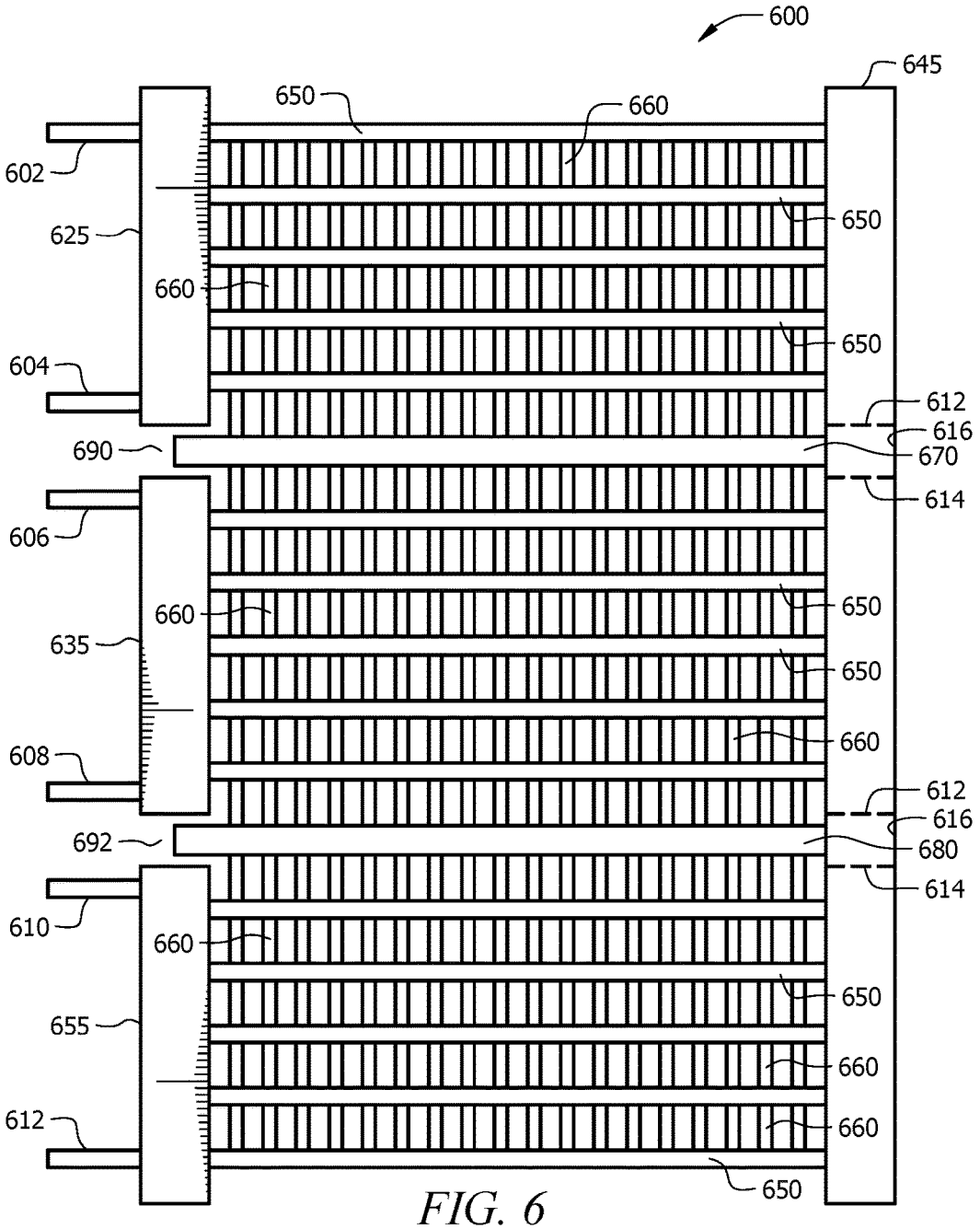
FIG. 6 is a diagram of an embodiment of a multistage condenser under the present disclosure.

FIG. 6 displays another possible embodiment under the present disclosure. Multistage condenser 600 comprises three stages. The first stage comprises inlet 602, outlet 604, I/O manifold 625, tubes 650, fins 660, and return manifold 645. The second stage comprises inlet 606, outlet 608, I/O manifold 635, tubes 650, fins 660, and return manifold 645. The third stage comprises inlet 610, outlet 612, I/O manifold 655, tubes 650, fins 660, and return manifold 645. Baffles 612, 614 prevent leaks from the first and second stages. Vents 616 can provide venting of gases. As with other embodiments, the different stages can be used for different load levels in an associated HVAC system. Sometimes all three stages will be used, other times just one or two. Dead tube 670 extends from return manifold 645 toward space 690 between the first and second I/O manifolds. Dead tube 680 extends from return manifold 645 toward space 692 between the second and third I/O manifolds.

The embodiment of FIG. 6 could also comprise the disclosures of FIG. 3 or 4. In such embodiments the dead tube may be cut short, or an I/O manifold may be cored out to avoid contact with the dead tube. The embodiment shown in FIG. 6 comprises three stages. More stages could be used however. In keeping with the present disclosure, a dead tube may be placed between neighboring stages when an outlet from one stage is close to an inlet from another stage. These are the areas where the greatest stresses occur. The dead tube can be cut shorter than other tubes in the condenser, a cored manifold may be used, or the I/O manifolds may be divided into multiple sections.

Figure 7:
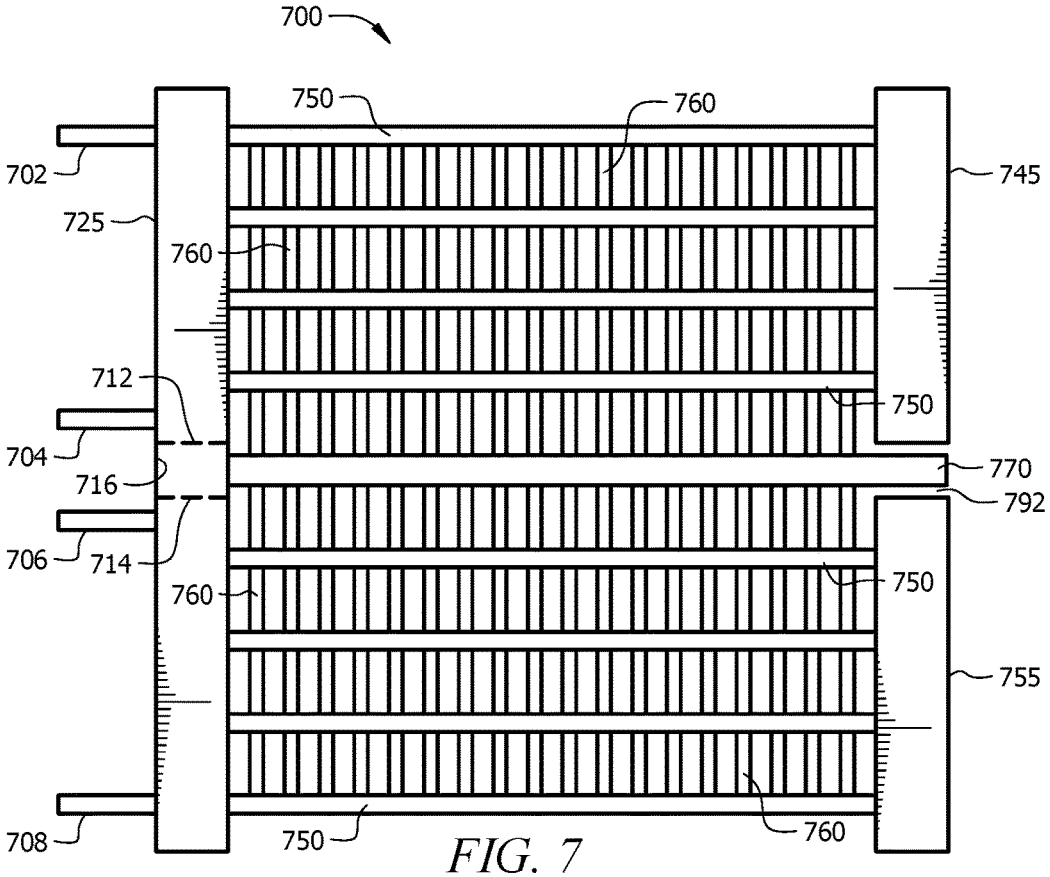
FIG. 7 is a diagram of an embodiment of a multistage condenser under the present disclosure.

Embodiments under the present disclosure can comprise a physical separation between the dead tube and the I/O manifold(s). Other embodiments under the present disclosure can also, or alternatively, comprise a physical separation between the dead tube and the return manifold. FIG. 7 displays such a possible embodiment. I/O manifold 725, return manifold 745, inlet 702, and outlet 704 circulate a refrigerant in a first stage. I/O manifold 725, return manifold 755, inlet 706, and outlet 708 circulate a refrigerant in a second stage. Dead tube 770 is disposed between the first and second stages and extends into space 792 between the return manifolds 745, 755. Baffles 712, 714 prevent leaks from the first and second stages. Vents 716 can provide venting of gases. This embodiment can help to reduce stresses and strains from thermal expansion and contraction in the return manifold.

Figure 8A:
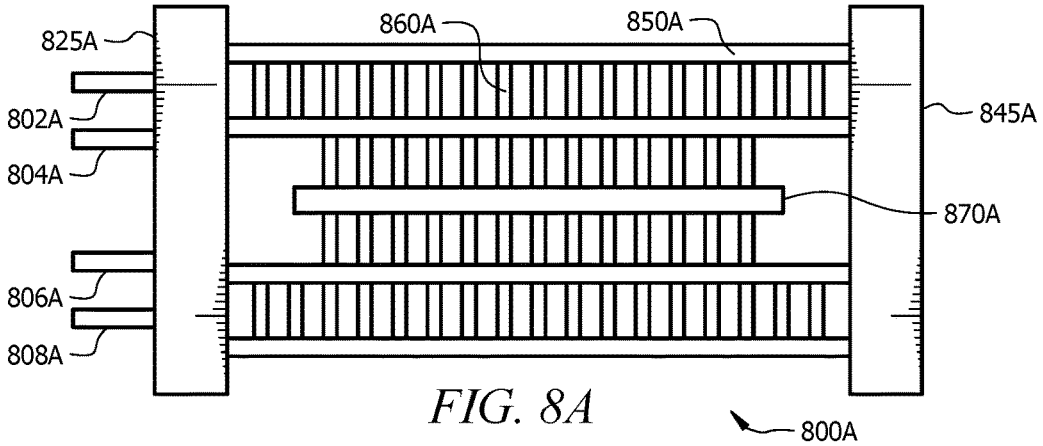
FIGS. 8A-8C are diagrams of embodiments of a multistage condenser under the present disclosure.
Figure 8B:
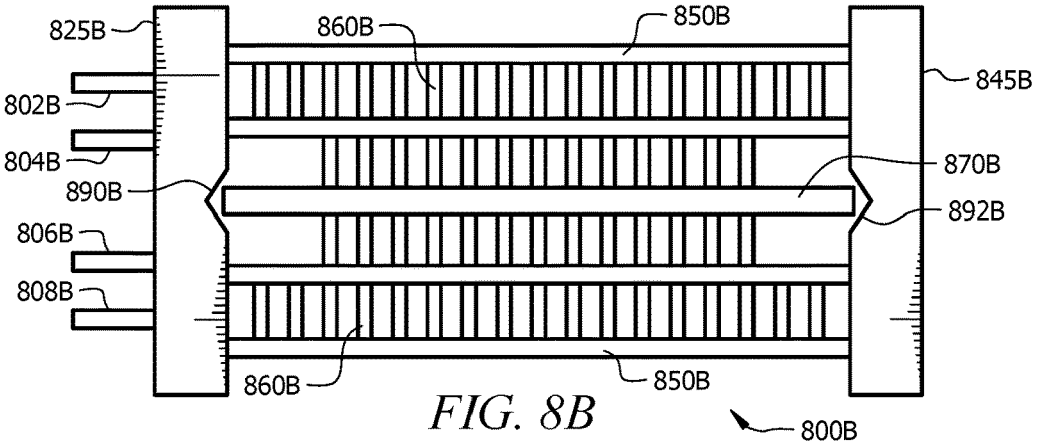
Figure 8C:
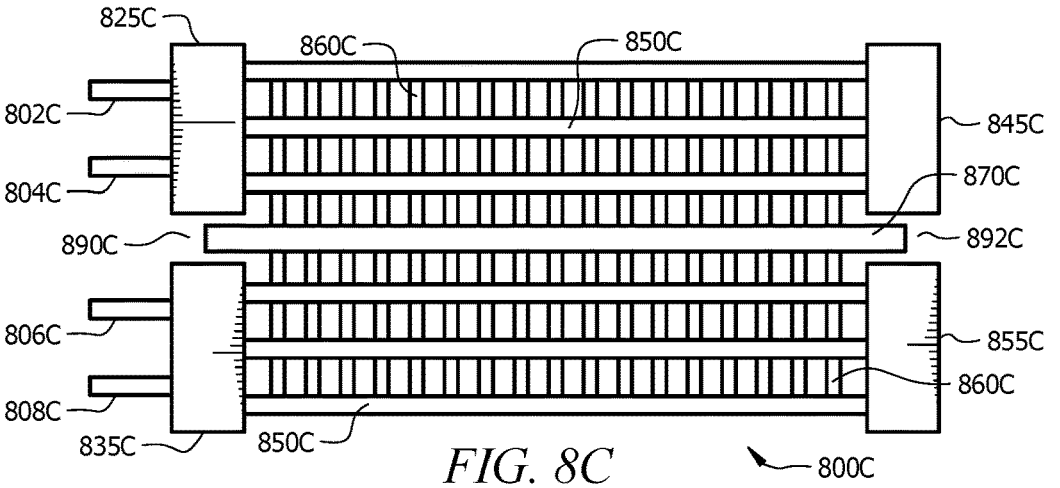

FIGS. 8A-8C display several other embodiments that feature a physical separation between the dead tube and both the I/O manifold and the return manifold. FIG. 8A shows an embodiment of a condenser 800A comprising a short dead tube 870A. FIG. 8B shows an embodiment of a condenser 800B comprising a dead tube 870B and cored portions 890B, 892B on the I/O manifold 825B and the return manifold 845B. FIG. 8C shows an embodiment of a condenser 800C comprising I/O manifold 825C and return manifold 845C in a first stage, and I/O manifold 835C and return manifold 855C in a second stage. The stages are separated by spaces 890C, 892C and dead tube 870C. Embodiments 800A-800C will preferably comprise baffles within the manifolds and on either side of the dead tube, or either side of several tubes around the dead tube. There may be several empty slots in the manifolds, where a dead tube or neighboring tube would, but for the present disclosure, engage the manifold.

Embodiments under the present disclosure can comprise multiple dead tubes between stages. Typical practice is to use one dead tube, but certain layouts or system requirements could make use of multiple dead tubes.

Figure 9:
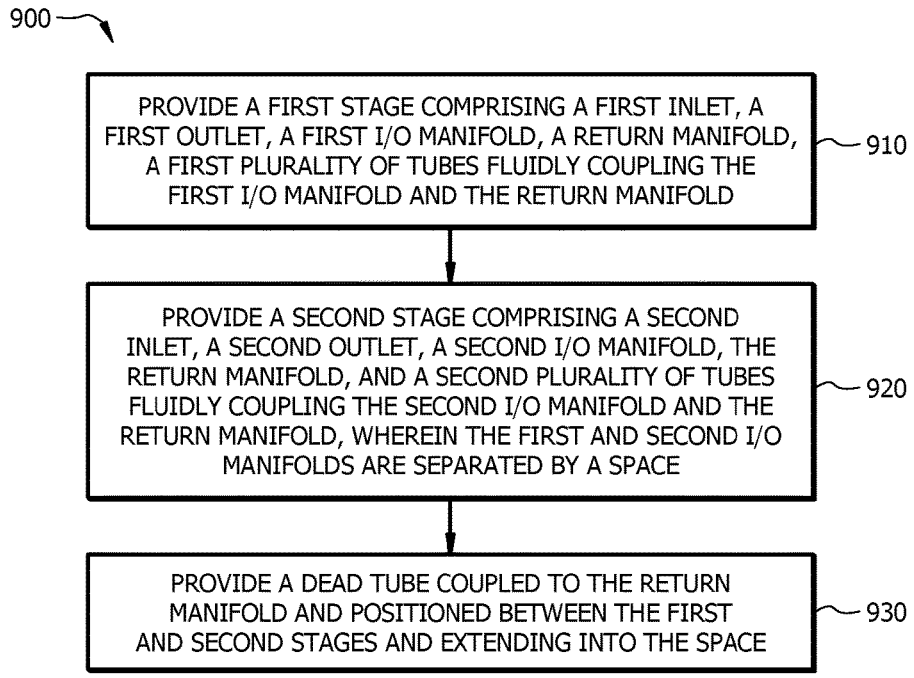
FIG. 9 is a flow chart diagram of a method embodiment under the present disclosure.

FIG. 9 displays a possible embodiment of a method 900 for manufacturing a multistage condenser under the present disclosure. At 910 a first stage is provided, the first stage comprising a first inlet, a first outlet, a first I/O manifold, a return manifold, and a first plurality of tubes fluidly coupling the first I/O manifold and the return manifold, the first stage configured to circulate a refrigerant. At 920, a second stage is provided, the second stage comprising a second inlet, a second outlet, a second I/O manifold, the return manifold, and a second plurality of tubes fluidly coupling the second I/O manifold and the return manifold, the second stage configured to circulate a refrigerant, wherein the second I/O manifold is separated from the first I/O manifold by a space. At 930, a dead tube is provided, the dead tube coupled to the return manifold and positioned between the first and second stages and extending into the space. In preferred method embodiments, the condenser or heat exchanger will be constructed before passing through a heating or brazing treatment. However, other process embodiments may vary the timing of brazing/heating.

Figure 10:
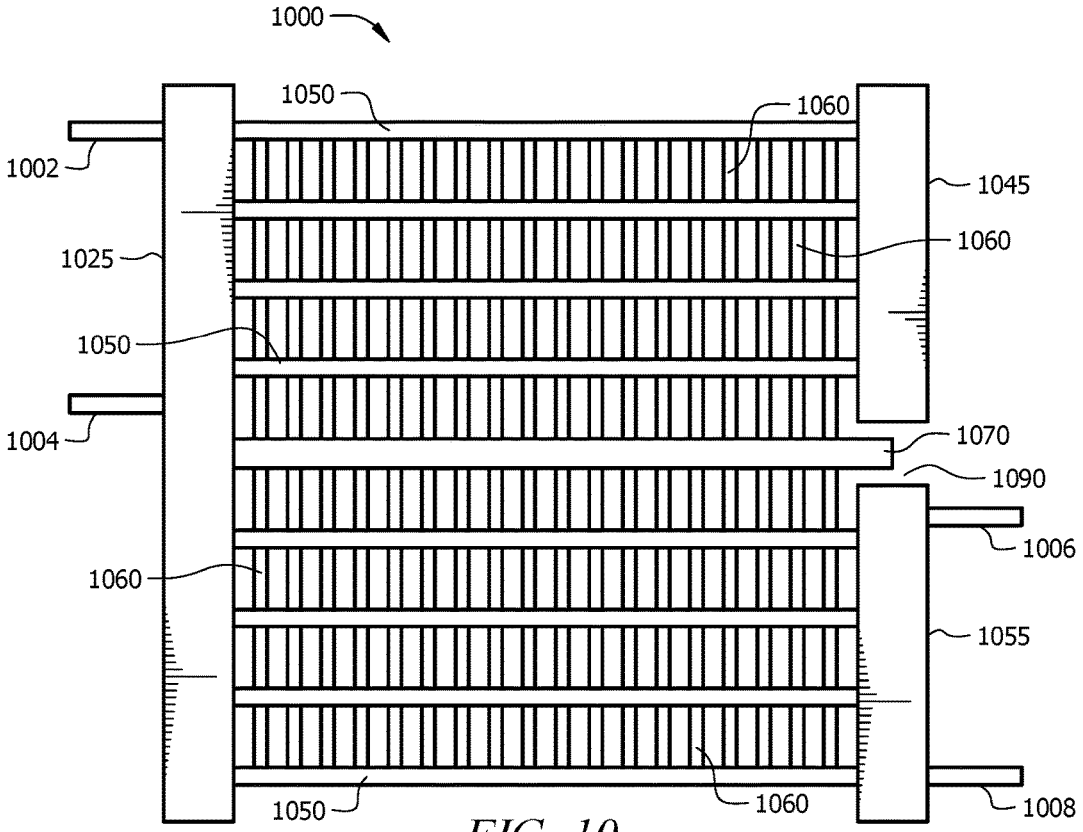
FIG. 10 is a diagram of an embodiment of a multistage condenser under the present disclosure.

FIG. 10 shows another possible embodiment under the present disclosure. In condenser 1000 the main manifold 1025 serves as an I/O manifold for a first stage. Return manifold 1045 is connected to main manifold 1025 by tubes 1050 and fins 1060 in the first stage. I/O manifold 1055, with inlet 1006 and outlet 1008, combines with main manifold 1025 to form a second stage. Here, the main manifold 1025 serves as a return manifold. Dead tube 1070 extends into space 1090 between return manifold 1045 and I/O manifold 1055, and is cut short on another side so as to not touch main manifold 1025.

Figure 11:
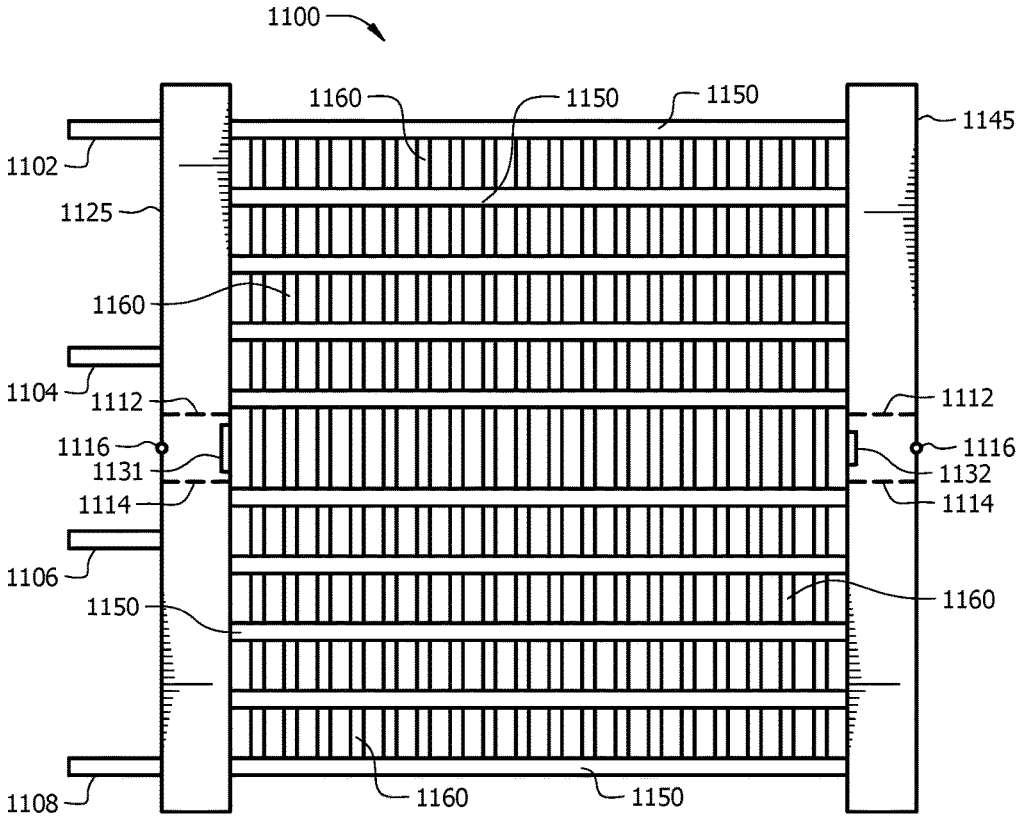
FIG. 11 is a diagram of an embodiment of a multistage condenser under the present disclosure.

FIG. 11 displays a further possible embodiment under the present disclosure. FIG. 11 comprises no dead tube. Manifolds 1125, 1145 are connected by tubes 1150 and fins 1160. A first stage is serviced by inlet 1102 and outlet 1104. A second stage is serviced by inlet 1106 and outlet 1108. Baffles 1112, 1114 prevent leaks from the first and second stages. Vents 1116 can provide venting of gases. Between the first and second stages there is no dead tube, just fins 1160. Slots 1131, 1132, or alternatively cored portions, can remain where a dead tube could have been inserted.

Various types of condensers, manifolds, dead tubes, and spacing mechanisms for separating a dead tube from a manifold, have been disclosed. Any combination of the foregoing may be used in certain circumstances, in keeping with the teachings of the present disclosure.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A multistage condenser for use in an HVAC system, comprising:

a first stage comprising a first plurality of tubes connected to a first inlet/outlet manifold, the first inlet/outlet manifold comprising:

a first inlet configured to receive refrigerant from a first compressor; and a first outlet configured to carry refrigerant away from the first inlet/outlet manifold;

a second stage comprising a second plurality of tubes connected to a second inlet/outlet manifold, the second inlet/outlet manifold comprising:

a second inlet configured to receive refrigerant from a second compressor; and a second outlet configured to carry refrigerant away from the second inlet/outlet manifold;

a return manifold connected to the first and second plurality of tubes and fluidly coupled to the first and second inlet/outlet manifolds; and a dead tube comprising:

a first end connected to the return manifold; and a second end extending at least partially into an open space that separates the first inlet/outlet manifold from the second inlet/outlet manifold such that the dead tube does not engage the first inlet/outlet manifold or the second inlet/outlet manifold;

wherein the dead tube extends continuously from the first end to the second end.

2. The multistage condenser of claim 1 wherein each tube of the first plurality of tubes and the second plurality of tubes comprises a plurality of channels.

3. The multistage condenser of claim 1 wherein a plurality of fins bordering the dead tube do not overhang the dead tube.

4. The multistage condenser of claim 1 wherein the first and second stages are oriented such that the second stage is beneath the first stage.

5. The multistage condenser of claim 1 wherein the first and second inlet/outlet manifolds circulate different refrigerants.

6. The multistage condenser of claim 1 further comprising a second dead tube.

7. A multistage condenser, comprising:

a first stage comprising a first inlet, a first outlet, a first inlet/outlet manifold, a first plurality of tubes, and a return manifold, the first stage configured to circulate a refrigerant;

a second stage comprising a second inlet, a second outlet, a second inlet/outlet manifold, a second plurality of tubes, and the return manifold, the second stage configured to circulate a refrigerant, wherein the second inlet/outlet manifold is separated from the first inlet/outlet manifold by an open space; and a dead tube comprising:

a first end connected to the return manifold; and a second end extending at least partially into the open space that separates the first inlet/outlet manifold from the second inlet/outlet manifold such that the dead tube does not engage the first inlet/outlet manifold or the second inlet/outlet manifold; and wherein the dead tube extends continuously from the first end to the second end.

8. The multistage condenser of claim 7 wherein each tube of the first plurality of tubes and the second plurality of tubes comprises a plurality of channels.

9. The multistage condenser of claim 7 wherein a plurality of fins bordering the dead tube do not overhang the dead tube.

10. The multistage condenser of claim 7 wherein the first and second stages circulate different refrigerants.

11. The multistage condenser of claim 7 wherein the first and second inlet/outlet manifolds are formed initially as two separate pieces and then assembled into one multistage condenser.

12. The multistage condenser of claim 7 further comprising a second dead tube.

13. A method of manufacturing a multistage condenser according to claim 1, the method comprising:

providing the first stage, the first stage comprising the first inlet, the first outlet, the first inlet/outlet manifold, the first plurality of tubes, and the return manifold, the first stage configured to circulate a refrigerant;

providing the second stage, the second stage comprising the second inlet, the second outlet, the second inlet/outlet manifold, the second plurality of tubes, and the return manifold, the second stage configured to circulate a refrigerant, wherein the second inlet/outlet manifold is separated from the first inlet/outlet manifold by the open space; and providing the dead tube, the dead tube coupled to the return manifold and positioned between the first and second stages and extending into the open space, wherein the dead tube does not engage the first inlet/outlet manifold or the second inlet/outlet manifold.

14. The method of claim 13 wherein the first inlet is configured to receive refrigerant from the first compressor and the second inlet is configured to receive refrigerant from the second compressor.

15. The method of claim 13 wherein the first and second stages circulate different refrigerants.

16. The method of claim 13 further comprising attaching a plurality of fins to the first and second plurality of tubes.

* * * * *